US008762027B2

(12) United States Patent
Kim

(10) Patent No.: US 8,762,027 B2
(45) Date of Patent: Jun. 24, 2014

(54) APPARATUS AND METHOD FOR CONTROLLING MOTOR

(75) Inventor: Chongwon Kim, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 113 days.

(21) Appl. No.: 13/299,060

(22) Filed: Nov. 17, 2011

(65) Prior Publication Data

US 2012/0143465 A1 Jun. 7, 2012

(30) Foreign Application Priority Data

Dec. 7, 2010 (KR) ..... 10-2010-0124219

(51) Int. Cl.
*F02D 45/00* (2006.01)

(52) U.S. Cl.
USPC ..... 701/102; 318/473

(58) Field of Classification Search
USPC ..... 123/90.15, 90.16, 90.19; 701/102
See application file for complete search history.

(56) References Cited

U.S. PATENT DOCUMENTS 6,622,678 B2 9/2003 Shimizu et al.
7,685,978 B2 * 3/2010 Fuwa et al. ..... 123/90.16
2008/0065308 A1 * 3/2008 Tanaka et al. ..... 701/102
2010/0019712 A1 1/2010 Morino et al.
2010/0145592 A1 * 6/2010 Yoo ..... 701/102

FOREIGN PATENT DOCUMENTS

JP 2001012262 A 1/2001
JP 2002004897 A 1/2002
JP 2003003900 A 1/2003
JP 2009268193 A 11/2009
JP 2010031661 A 2/2010
JP 2010-265819 A 11/2010
KR 1020060018889 A 3/2006

* cited by examiner

*Primary Examiner* — Stephen K Cronin
*Assistant Examiner* — Elizabeth Hadley
(74) *Attorney, Agent, or Firm* — Morgan, Lewis & Bockius LLP

(57) ABSTRACT

Disclosed is an apparatus for controlling a motor that determines whether or not to control the motor in order to control a variable valve lift device by using a measurement value of a valve lift and a target value of the valve lift; compares a predetermined base temperature with a temperature of an engine room in order to control the motor; determines a temperature factor corresponding to the temperature of the engine room when the temperature of the engine room is larger than the base temperature; and determines a driving signal value for the motor by applying the temperature factor to a predetermined base signal value.

8 Claims, 2 Drawing Sheets

APPARATUS AND METHOD FOR CONTROLLING MOTOR

CROSS-REFERENCE TO RELATED APPLICATIONS

The present application claims priority to Korean Patent Application Number 10-2010-0124219 filed Dec. 7, 2010, the entire contents of which application is incorporated herein for all purposes by this reference.

BACKGROUND OF THE INVENTION

1. Field of the Invention

The present invention relates to an apparatus and a method for controlling a motor. More particularly, the present invention relates to an apparatus and a method for controlling a motor driving a continuously variable valve lift device.

2. Description of Related Art

A continuously variable valve lift (hereinafter, referred to as 'CVVL') system varies an opening/closing level of a valve by varying a press level of a cam through rotation of an eccentric control shaft. In this case, a valve lift representing the opening/closing level of the valve is determined according to an angle value of the control shaft and the angle value of the control shaft is varied by a motor.

The CVVL system varies the angle value of the control shaft within a predetermined operation range by controlling the motor according to a difference between a present value and a target value of the valve lift so as to control the valve lift. In this case, in the CVVL system, since the valve lift determines an air volume, i.e., a driving force of an engine, control performance of the valve lift is a key element to determine control and reaction performance of the engine.

When an apparatus is controlled through the motor, the motor consumes high current due to conditions (e.g., cold starting, before breaking in a vehicle, high RPM, and the like) in which control resistance of the apparatus is deteriorated.

In this case, when an internal temperature of the apparatus is increased by the high current, an electrical endurance limit and rigidity of each component are deteriorated and a current-resistant value of a wire on which the high current flows is decreased with an increase in a surrounding temperature, such that the wire may be damaged or a fire may occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to provide an apparatus and a method for controlling a motor for performing optimal apparatus control as well as protecting a system by determining an influence which a driving condition of a motor according to an apparatus controlling environment exerts on a system.

An exemplary embodiment of the present invention provides a method for controlling a motor in link with a variable valve lift device, the method including determining whether or not to control the motor in order to control the variable valve lift device by using a measurement value of a valve lift and a target value of the valve lift; comparing a predetermined base temperature with a temperature of an engine room in order to control the motor; determining a temperature factor corresponding to the temperature of the engine room when the temperature of the engine room is larger than the base temperature; and determining a driving signal value for the motor by applying the temperature factor to a predetermined base signal value.

Another exemplary embodiment of the present invention provides an apparatus for controlling a motor, which is installed in an engine room to control a variable valve lift, the apparatus including a motor, a positional sensor, a temperature sensor, and a controller. The motor controls a valve lift in link with the variable valve lift. The positional sensor measures the valve lift. The temperature sensor measures a temperature of the engine room. The controller determines whether or not to control the motor according to a measurement value of the valve lift measured through the positional sensor, determines a driving signal value by using the measurement temperature measured through the temperature sensor in order to control the motor, and controls the motor according to the driving signal value.

According to the exemplary embodiments of the present invention, a motor controlling component is protected preventing application of high current by separately/dually controlling a motor according to a temperature of an engine room, as the temperature of the engine room increases and motor current is controlled to meet required current demands of various electronic devices, safe and reliable component protection is performed to prevent damage and a failure of a vehicle as a limp home function is driven when current-resistant performance of the motor controlling component according to the temperature of the engine room is optimized, and control performance is improved by minimizing friction force when it is not smooth to control a CVVL.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
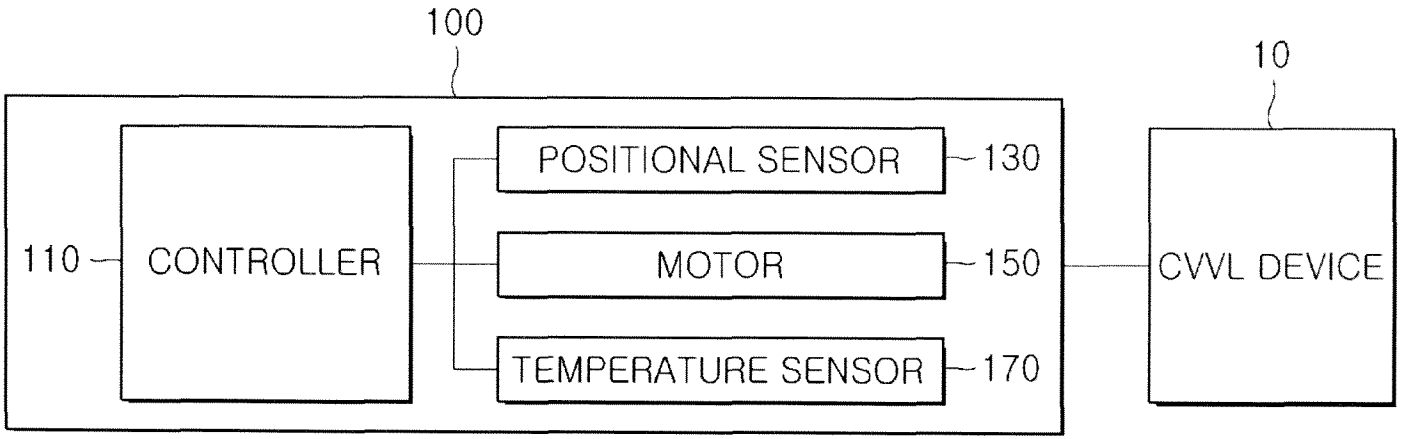
FIG. 1 is a diagram showing a configuration of an apparatus for controlling a motor according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an apparatus and a method for controlling a motor according to exemplary embodiments of the present invention will be described with reference to the accompanying drawings.

Referring to FIG. 1 showing a configuration of the apparatus for controlling a motor according to an exemplary embodiment of the present invention, the motor controlling apparatus 100 according to the exemplary embodiment of the present invention includes a positional sensor 130, a motor 150, and a temperature sensor 170. Motor controlling apparatus 100 controls a valve lift of a continuously variable valve lift (hereinafter, referred to as 'CVVL') device 10 through motor 150.

A controller 110 controls motor 150 according to a pulse width modulation (hereinafter, referred to as 'PWM') scheme.

Positional sensor 130 measures the valve lift of CVVL device 10.

Motor 150 controls the valve lift in link with CVVL device 10.

Temperature sensor 170 measures a temperature of an engine room in which motor controlling apparatus 100 is installed.

Next, a method in which the motor controlling apparatus controls a motor according to an exemplary embodiment of the present invention will be described with reference to FIG. 2.

Figure 2:
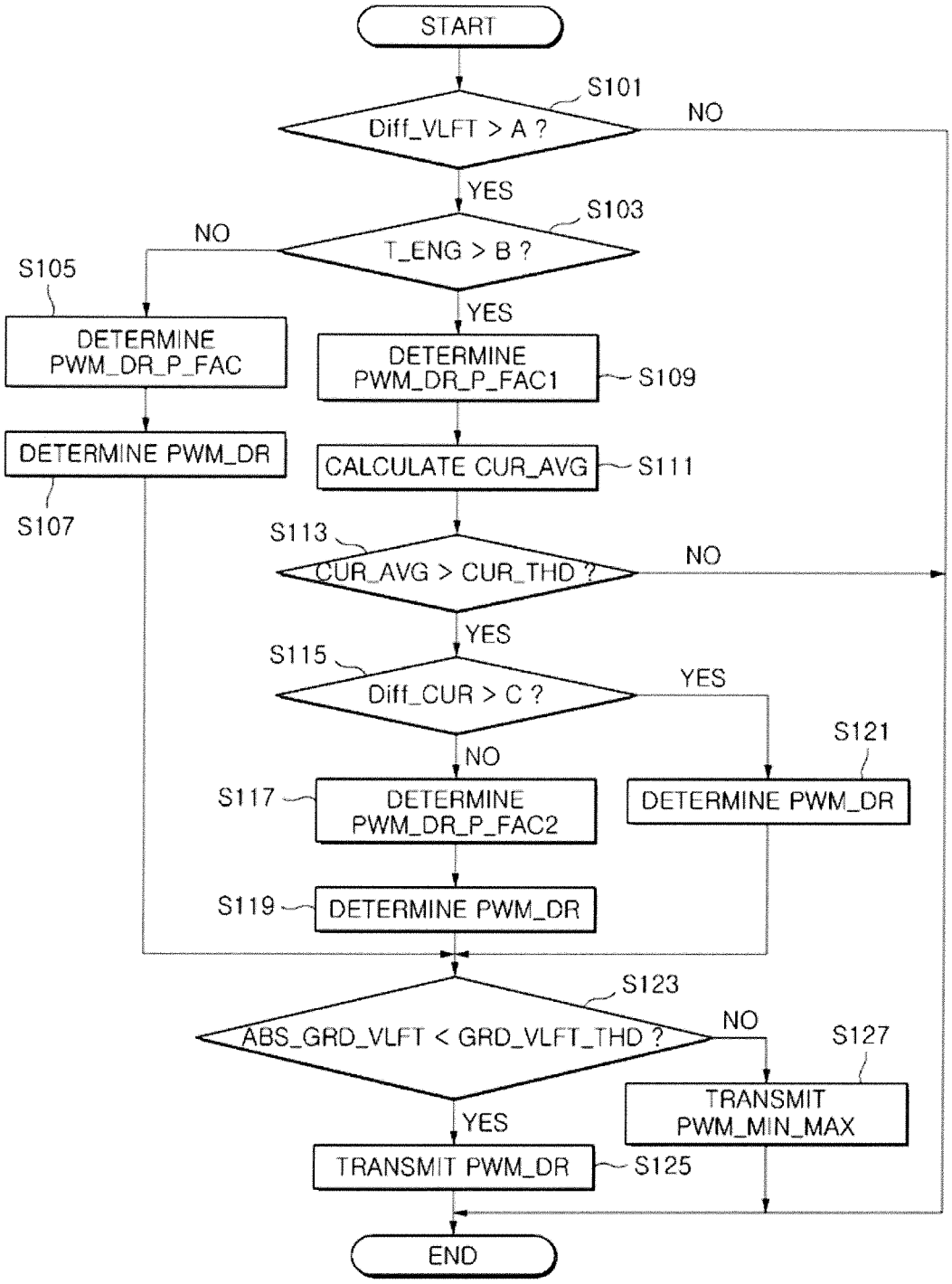
FIG. 2 is a diagram showing a method for controlling a motor according to another exemplary embodiment of the present invention.

Referring to FIG. 2 showing the method for controlling a motor according to the exemplary embodiment of the present invention, first, controller 110 determines whether a difference value of the valve lift Diff_VLFT corresponding to a difference value between a measurement value of the valve lift and a target value of the valve lift is larger than a predetermined threshold value A (S101).

According to a determination result of step S101, when difference value of the valve lift Diff_VLFT is larger than threshold value A, controller 110 determines whether a temperature T_ENG of the engine room is larger than a predetermined base temperature B (S103).

According to a determination result of step S103, when temperature of the engine room T_ENG is not larger than base temperature B, controller 110 determines a PWM factor PWM_DR_P_FAC for reducing current (S105). Herein, controller 110 may determine PWM factor PWM_DR_P_FAC as "0".

Next, controller 110 determines a PWM driving signal value PWM_DR by using a PWM base signal value PWM_BAS and PWM factor PWM_DR_P_FAC corresponding to valve lift difference value Diff_VLFT (S107). Herein, controller 110 may calculate PWM driving signal value PWM_DR according to Equation 1.

$$PWM_DR=PWM_BAS*(1-PWM_DR_P_FAC) \quad \text{[Equation 1]}$$

According to the determination result of step S103, when temperature of the engine room T_ENG is larger than base temperature B, controller 110 determines a first PWM factor PWM_DR_P_FAC1 according to temperature of the engine room T_ENG (S109). Herein, controller 110 may determine first PWM factor PWM_DR_P_FAC1 by using a first PWM factor table that is previously stored. In this case, the first PWM factor table may follow Table 1.

TABLE 1

| T_ENG | 70° C. | 80° C. | . . . | 120° C. |
|---|---|---|---|---|
| PWM_DR_P_FAC1 | 0.05 | 0.10 | . . . | 0.50 |

Next, controller 110 calculates a current average value CUR_AVG by using the amount of current applied to motor 150 for a predetermined time (S111).

Thereafter, controller 110 determines whether current average value CUR_AVG is larger than a predetermined current threshold value CUR_THD (S113). Herein, current threshold value CUR_THD as a limit current value of a wire between controller 110 and motor 150 may be determined according to temperature of the engine room T_ENG and may also be determined according to Table 2.

TABLE 2

| T_ENG | 70° C. | 80° C. | . . . | 120° C. |
|---|---|---|---|---|
| CUR_THD | 35A | 30A | . . . | 15A |

According to a determination result of step S113, when current average value CUR_AVG is larger than current threshold value CUR_THD, controller 110 determines whether a current difference value Diff_CUR corresponding to a difference value between current average value CUR_AVG and current threshold value CUR_THRD is larger than a predetermined threshold value C (S115).

According to a determination result of step S115, when current difference value Diff_CUR is not larger than threshold value C, controller 110 determines a second PWM factor PWM_DR_P_FAC2 according to the current difference value (S117). Herein, controller 110 may determine second PWM factor PWM_DR_P_FAC2 by using a second PWM factor table that is previously stored. In this case, the second PWM factor table may follow Table 3.

TABLE 3

| Diff_CUR | 1A | 2A | . . . | 5A |
|---|---|---|---|---|
| PWM_DR_P_FAC2 | 0.2 | 0.3 | . . . | 0.0 |

Next, controller 110 determines PWM driving signal value PWM_DR by using PWM base signal value PWM_BAS, first PWM factor PWM_DR_P_FAC1, and second PWM factor PWM_DR_P_FAC2 corresponding to valve lift difference value Diff_VLFT (S119). Herein, controller 110 may calculate PWM driving signal value PWM_DR according to Equation 2.

$$PWM_DR=PWM_BAS*(1-PWM_DR_P_FAC1-PWM_DR_P_FAC2) \quad \text{[Equation 2]}$$

According to the determination result of step S115, when current difference value Diff_CUR is larger than threshold value C, controller 110 determines PWM driving signal value PWM_DR according to a PWM limitation table applied when PWM limitation according to current is required (S121). Herein, according to the determined PWM driving signal value PWM_DR, motor 150 maintains a holding duty at the time of reaching the maximum valve lift.

Thereafter, controller 110 determines whether a predetermined base value of a gradation amount of the valve lift GRD_VLFT_THD is larger than an absolute value of the gradation amount of the valve lift ABS_GRD_VLFT depending on PWM driving signal value PWM_DR (S123).

According to a determination result of step S123, when base value of the gradation amount of the valve lift GRD_VLFT_THD is larger than absolute value of the gradation amount of the valve lift ABS_GRD_VLFT, controller 110 transmits determined PWM driving signal value PWM_DR to motor 150 and controls motor 150 according to determined PWM driving signal value PWM_DR (S125).

According to the determination result of step S123, when base value of the gradation amount of the valve lift GRD_VLFT_THD is not larger than absolute value of the gradation amount of the valve lift ABS_GRD_VLFT, controller 110 transmits minimum and maximum PWM signal values PWM_MIN_MAX to motor 150 and controls motor 150 according to minimum and maximum PWM signal values PWM_MIN_MAX in order to alleviate driving resistance force of motor 150 and smoothly drive motor 150 (S127). Herein, controller 110 drives a maximum value to a minimum value of the PWM signal value at a predetermined cycle for a predetermined time according to minimum and maximum PWM signal values PWM_MIN_MAX to ensure smooth driving of motor 150.

According to the determination result of step S101, when valve lift difference value Diff_VLFT is not larger than threshold value A, controller 110 ends the motor controlling method.

According to the determination result of step S113, when current average value CUR_AVG is not larger than current threshold value CUR_THD, controller 110 ends the motor controlling method.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for controlling a motor in link with a variable valve lift device, the method comprising:

determining whether or not to control the motor in order to control the variable valve lift device by using a measurement value of a valve lift and a target value of the valve lift;

comparing a predetermined base temperature with a temperature of an engine room in order to control the motor;

determining a temperature factor corresponding to the temperature of the engine room when the temperature of the engine room is larger than the base temperature; and determining a driving signal value for the motor by applying the temperature factor to a predetermined base signal value;

determining a current factor corresponding to the amount of current applied to the motor, wherein in the determining of the driving signal value, the driving signal value is determined by applying the temperature factor and the current factor to the base signal value;

wherein the determining of the current factor includes:

determining a current average value for a predetermined time by using the current amount; and determining the current factor by using a current difference value corresponding to a difference between the current average value and a predetermined current threshold value, and wherein the driving signal value is determined by Equation: Driving signal value=a base signal value*(1−temperature factor−current factor).

2. The method as defined in claim 1, wherein the current threshold value corresponds to the temperature of the engine room.

3. The method as defined in claim 1, further comprising determining the driving signal value according to a predetermined stored table in order to limit driving of the motor when the current difference value is larger than a predetermined threshold value.

4. The method as defined in claim 1, wherein in the determining whether or not to control the motor, whether or not to control the motor is determined according to a valve lift difference value corresponding to a difference between the measurement value of the valve lift and the target value of the valve lift.

5. The method as defined in claim 4, wherein in the determining of the driving signal value, the driving signal value is determined by using the base signal value corresponding to the valve lift difference value.

6. The method as defined in claim 1, wherein when the temperature of the engine room is not larger than the reference temperature, the driving signal value is determined Equation: Driving signal value=a base signal value*(1−a first PWM factor).

7. The method as defined in claim 6, wherein the factor for reducing the current is 0 (zero).

8. The method as defined in claim 7, further comprising:

controlling the motor according to the driving signal value when a gradation amount of the valve lift according to the driving signal value is smaller than a predetermined base value; and driving the motor according to a predetermined maximum signal value and a predetermined minimum signal value when the gradation amount of the valve lift according to the driving signal value is larger than the predetermined base value.

* * * * *